US005356002A

United States Patent [19]

Brown

[11] Patent Number: 5,356,002

[45] Date of Patent: Oct. 18, 1994

[54] BASEBALL/SOFTBALL SPORT UTILITY BAG

[75] Inventor: Gregory C. Brown, Manchaug, Mass.

[73] Assignee: Pamela Brown, Corona del Mar, Calif. ; a part interest

[21] Appl. No.: 38,916

[22] Filed: Mar. 29, 1993

[51] Int. Cl.[5] ..... A45C 3/00

[52] U.S. Cl. ..... 206/315.1; 190/111

[58] Field of Search ..... 150/111-117; 190/109-111; 206/315.1, 315.11, 443

[56] References Cited

U.S. PATENT DOCUMENTS

| | | | |
|---|---|---|---|
| 2,802,501 | 8/1957 | Stember | 150/117 |
| 3,110,333 | 11/1963 | Stember | 150/117 |
| 3,963,102 | 6/1976 | Carp | 150/112 |
| 4,301,898 | 11/1981 | Plough et al. | 150/117 |
| 4,966,279 | 10/1990 | Pearcy | 190/111 |
| 5,052,555 | 10/1991 | Harmon | 190/111 |

*Primary Examiner*—Jimmy G. Foster
*Attorney, Agent, or Firm*—Kaplan and Mugno

[57] ABSTRACT

A sport utility bag is disclosed which includes a plurality of individually accessible compartments on said utility bag with at least one of said compartments having access means on said bottom panel of said bag to allow easy cleaning, said bag also comprising an elongate compartment extending along a length of said utility bag designed to securely carry a rod-shaped object such as a bat. The novel bag prevents items from cluttering and interfering with each other, and ensures that dirt from certain items does not contaminate other items.

9 Claims, 3 Drawing Sheets

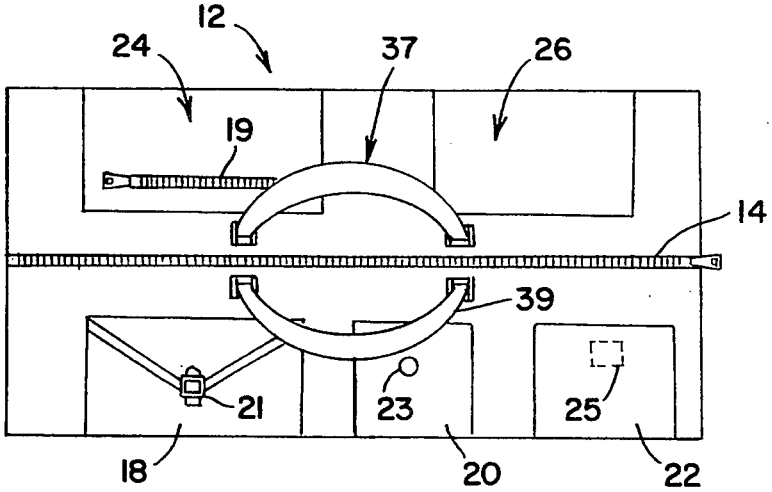
FIG. 1
FIG. 4
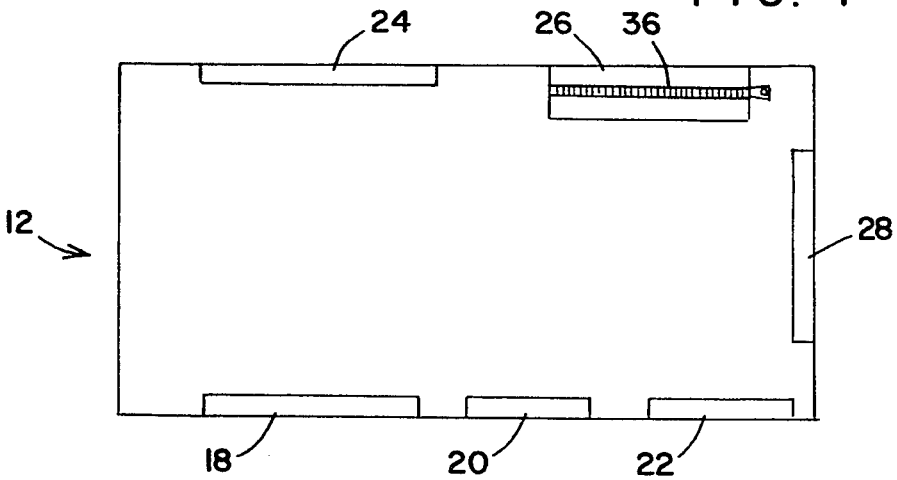
FIG. 3
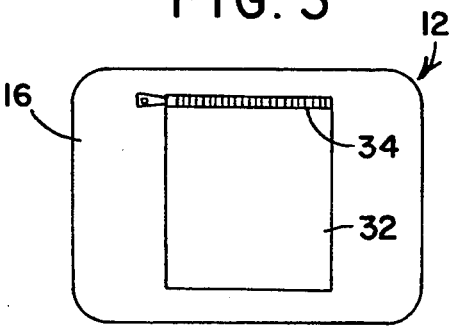
FIG. 2
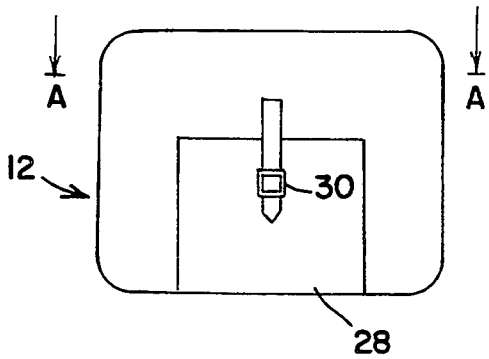

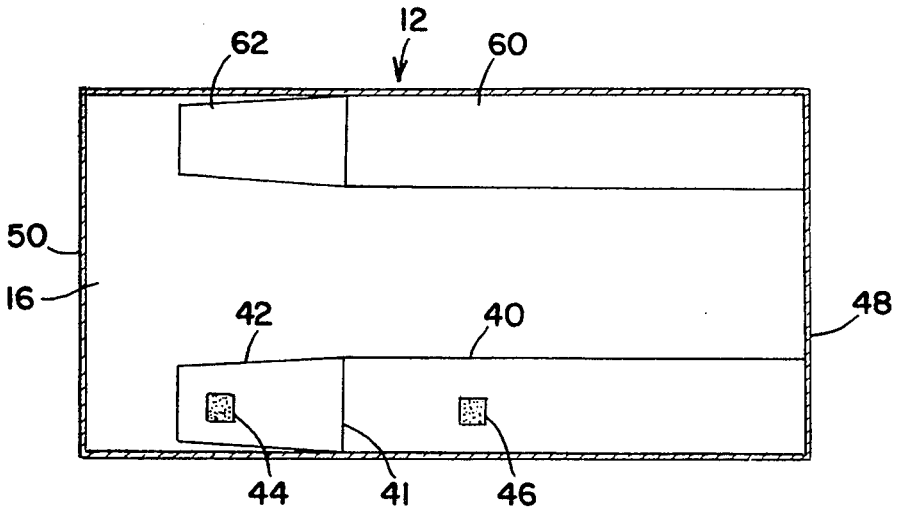
FIG. 5
FIG. 7
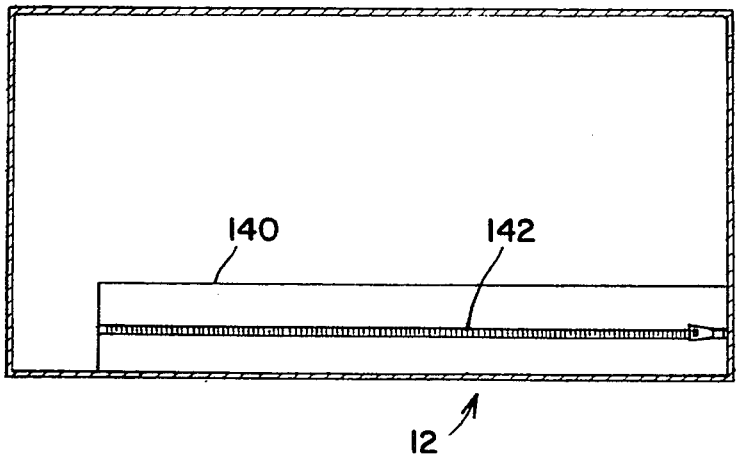
FIG. 6
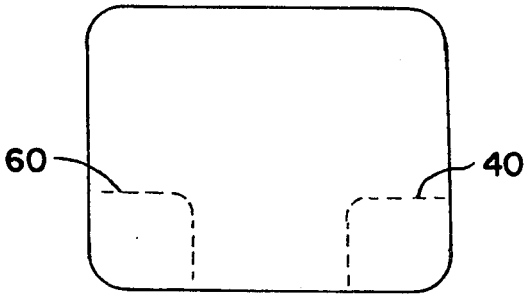
FIG. 8
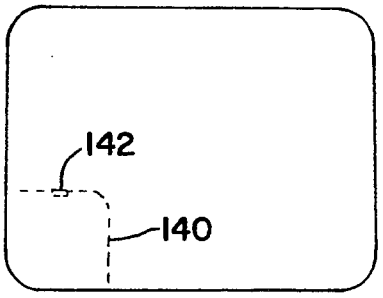

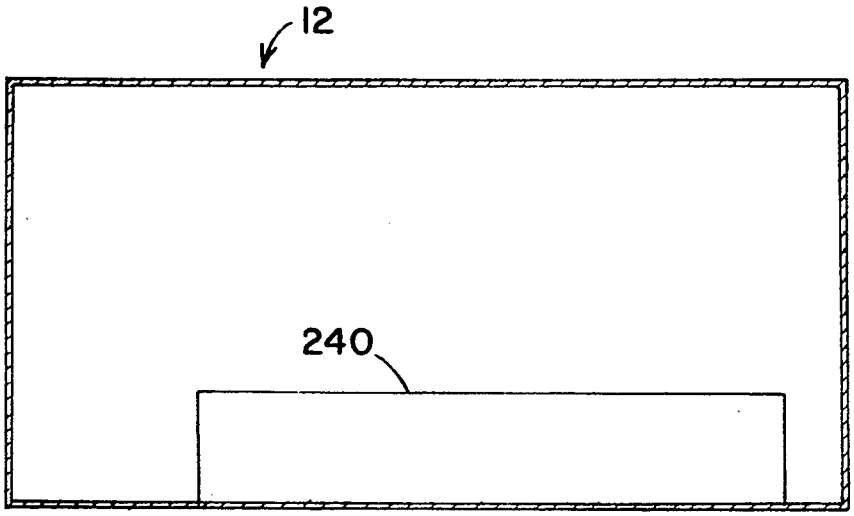
FIG. 9
FIG. 11
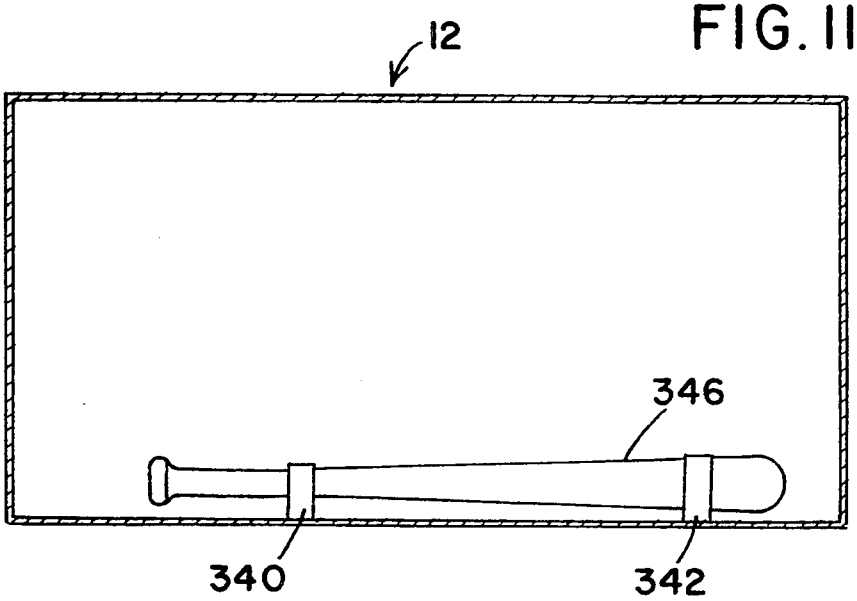
FIG. 10
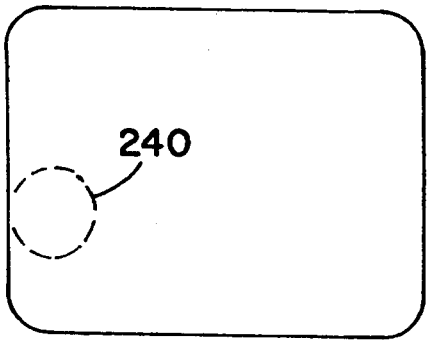
FIG. 12
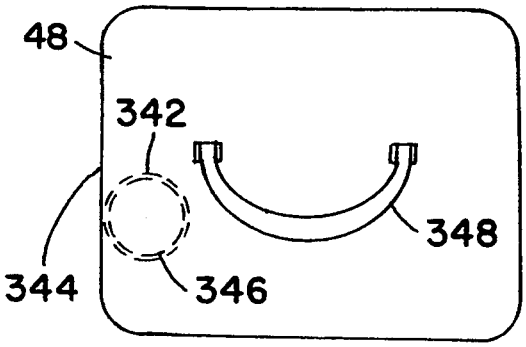

BASEBALL/SOFTBALL SPORT UTILITY BAG

FIELD OF THE INVENTION

This invention is generally directed to a sport utility bag for carrying and transporting sports equipment. More specifically, this invention is directed to a baseball/softball utility bag have separately accessible compartments for individually storing a glove, clipboard, bats, spikes, etc., and which enables the athlete to avoid debris from his/her spikes from contacting the rest of the equipment stored in the bag.

BACKGROUND OF THE INVENTION

It is well-known to both the casual weekend athlete and the professional player, that one of the most unpleasant tasks associated with playing baseball/softball is transporting all necessary equipment to and from the ball field. A non-exhaustive list of desired equipment includes a baseball glove, a batting glove, baseballs, athletic shoes (i.e. cleats or spikes), a water bottle, a score book and a helmet.

While the prior art provides sport utility bags with storage compartments large enough to carry the player's equipment, these conventional bags are still inconvenient because of the "jumbling" of all equipment in one compartment. First, the "jumbling" of all equipment makes it difficult for the athlete to quickly locate the specific piece of equipment desired at a particular time. Secondly, items such as cleats often accumulate debris (i.e. mud, grass, etc.) which becomes dislodged as the cleats are transported. Clearly, it is undesirable for this debris to be spread on items such as the score book, and it is outright unsanitary for the debris to come in contact with items such as the water bottle. Finally, even if "dirty" items such as cleats are maintained in the sport bag separately from other items, the debris will still become dislodged in the bag, and it becomes difficult to clean without the user first emptying the entire contents of the bag, and turning the bag upside down.

More recently, sport utility bags have become available which do comprise separate compartments in which certain items can be stored. However, these bags still are difficult to clean and also hold many heavier items (such as bats) loosely, which makes the bag more difficult to carry and more likely to cause damage to other, lighter items contained in the bag.

It is, therefore, a primary object of the present invention to provide a new and improved sport utility bag which eliminates the above-identified deficiencies of prior art bags.

It is another object of the present invention to provide a new and improved sport utility bag that provides compartments specifically shaped for particular pieces of equipment.

It is still a further object of the present invention to provide a new and improved sport utility bag that provides at least one compartment having access means on the bottom surface of the bag to enable easy cleaning thereof.

It is yet another object of the present invention to provide a new and improved sport utility bag that provides a secured elongate section for carrying a generally rod-shaped object such as a bat, a hockey stick, a lacrosse stick or the like.

Further objects and advantages of the present invention will become apparent as the following description proceeds.

SUMMARY OF THE INVENTION

Briefly stated and in accordance with one embodiment of the present invention, a sport utility bag is provided which includes (i) a plurality of panels which forms a primary storage area, (ii) closure means for sealing said primary storage area, (iii) a plurality of individually accessible compartments on said utility bag with at least one compartment having access means on said bottom panel of said bag, (iv) handle means coupled to said bag for grasping said utility bag, and (v) a first elongate section designed to securely carry a first bat. A second, optional elongate section designed to securely carry a second bat can also be included in the novel sport utility bag presented herein.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the following description, taken in conjunction with the accompanying drawings, wherein:

FIG. 1 is a top view of the outside of the sport utility bag constructed in accordance with the present invention;

FIG. 2 is a right end view of the sport utility bag shown in FIG. 1;

FIG. 3 is a left end view of the sport utility bag shown in FIG. 1;

FIG. 4 is a bottom view of the sport utility bag shown in FIG. 1;

FIG. 5 is a sectional view of the inside of the sport utility bag shown in FIG. 1 taken along the line A—A of FIG. 2 and illustrating a first alternative design for an elongate section of the present invention;

FIG. 6 is a right side view of the sport utility bag of FIG. 5;

FIG. 7 is a sectional view of the inside of the sport utility bag shown in FIG. 1 taken along the line A—A of FIG. 2 and illustrating a first alternative design for an elongate section of the present invention;

FIG. 8 is a right side view of the sport utility bag of FIG. 7;

FIG. 9 is a sectional view of the inside of the sport utility bag shown in FIG. 1 taken along the line A—A of FIG. 2 and illustrating a first alternative design for an elongate section of the present invention;

FIG. 10 is a right side view of the sport utility bag of FIG. 9;

FIG. 11 is a sectional view of the inside of the sport utility bag shown in FIG. 1 taken along the line A—A of FIG. 2 and illustrating a first alternative design for an elongate section of the present invention; and FIG. 12 is a right side view of the sport utility bag of FIG. 11.

DETAILED DESCRIPTION OF THE DRAWINGS

Referring specifically to FIG. 1, a top view of a sport utility bag, generally designated 12, is illustrated. Bag 12 comprises a zipper 14 extending along its length to close and open the bag, thereby providing access to primary internal storage area 16. Bag 12 further comprises a plurality of separate compartments 18, 20, 22, 24 and 26 provided on the outside of bag 12 to hold different pieces of sports equipment. For instance, compartment 18 can be used for carrying a glove, compartment 20 for a batting glove, compartment 24 for weight donuts for the bats, and compartment 26 for the player's athletic shoes. Bulkier items such as a batting helmet, uniform or shin guards are more easily carried in primary storage area 16 as opposed to separate compartments. Each of the compartments 18, 20, 22 and 24 has separate access means such as zipper 19, a strap and buckle 21, a snap 23 or a VELCRO loop and hook pair 25 to enable the player to separately access such compartments.

Bag 16 can be described as being comprised of a top panel, a bottom panel, two side panels and two end panels but this is only for simplifying references to particular positions of the bag; separate panels are not necessary. For instance, bag 12 if cylindrically shaped can actually be comprised of two circular end panels and a middle piece of material. Alternatively, bag 12 can be rectangular in shape. As seen from the end views (FIGS. 2 and 3) bag 12 is shown as a generally rectangular bag with curved edges. Bag 12 is also ideally comprised of a soft-walled material such as canvas which contains linings or inserts which allows bag 16 to maintain a semi-rigid shape.

Also visible in FIG. 1 are handle means for grasping and transporting bag 12. The handle means shown are comprised of complementary straps 37 and 39 on the top panel of bag 12. However, a single strap extending from the end panels of bag 12 can also be implemented, or other known handle means can be incorporated. Furthermore, the handle means can be removable by means of metal clips as is well known in the art.

In FIG. 2, it is evident that another separate compartment 28 has been provided which is sealable by means of strap 30. Compartment 28 extends to the bottom of bag 12. On the left end of bag 12 (FIG. 3) there is another compartment 32 which is sealable by zipper 34 and only extends for a portion of the depth of bag 12.

Referring now to FIG. 4, the outside of bag 12 of FIG. 1 is illustrated. The bottom edges of compartments 18, 20, 22, 24, 26, and 28 are visible. Compartment 26 has a zipper 36 to provide access to the compartment from the bottom of bag 12. The placement of zipper 36 on the underside of bag 12 ensures that when any stored athletic shoes are removed, all dirt and debris easily falls from the bag due to gravitational forces. Thus, compartment 26 not only keeps unsanitary shoes separate from other equipment being carried, but its zipper 36 allows for easy removal of the isolated dirt.

Although not illustrated in FIGS. 1–4 for purposes of clarity, bag 12 also comprises a separate elongate section for holding a rod-shaped object such as a bat, lacrosse stick or a hockey stick as will be further described in connection with FIGS. 5–12.

In a first alternative design illustrated in FIG. 5 and FIG. 6, an elongate compartment 40 can be placed either internally within primary storage area 16 or on the outside surface of bag 12. Compartment 40 includes an open end 41 to receive the rod-shaped object and a flap 42 to fold over open end 41 once the object is inserted. Flap 42 and compartment 40 include a mating pair of VELCRO loop and VELCRO hook 46 to seal open end 41.

Depending on the length of bag 12, when compartment 40 is internally placed, it is often preferable to place compartment 40 so that one end of it begins against an end wall of bag 12. This not only enables the closed end of the compartment 40 to be comprised of end panel 48 itself (thus reducing construction costs), but also facilitates the placement of the rod-shaped object in the compartment without the bat being interfered with by end panel 50. In another possible modification, end panel 50 could have a zipper around three sides of its perimeter to enable it to be opened when placing objects in compartment 40 and closed once the objects are in place in bag 16. Finally, with regard to FIGS. 5 and 6, a second elongate compartment 60 and flap 62 can be provided to hold a second rod-shaped object.

Turning now to FIGS. 7 and 8, a second possible design for a separate elongate compartment is illustrated. Compartment 140 includes a zipper 142 to enable access to compartment 140. When using this zipper design, there is no need to place the elongate compartment toward one end or the other of bag 12 or to provide a "fold-back" end panel.

Another alternative design is illustrated in FIGS. 9–10 in which an elastic or other flexible material is used to create a tubular compartment 240 to hold the rod-like object. The inherent elasticity of the material is sufficient to hold an object such as a bat in place while carrying bag 12.

Yet another alternative design for the elongate section of sport utility bag 12 is illustrated in FIGS. 11–12 in which an elastic strip of material 340 and an elastic strip of material 342 each have its ends stapled, sewn, or otherwise connected to side panel 344 so as to form two retaining loops. A bat 346 is shown engaged in elements 340 and 342 in a position by which it can be securely carried. The material strips 340 and 342 can also be formed into retaining loops by VELCRO loop and hook tabs, whereby the tabs are opened to receive bat 346, then secured when bat 346 is in place. A handle 348 is also illustrated in FIG. 12 on end panel 48 to enable the user to grasp bag 12 from its end or to allow bag 12 to be dragged.

It will be apparent from the foregoing description that the present invention provides a sport utility bag having numerous and separate compartments for carrying individual pieces of equipment including at least one compartment with closure means on the underside of said bag to permit easy cleaning. The bag also provides unique means for securing a rod-shaped object such as a bat in order to avoid it from damaging other items stored in the bag.

While there has been shown and described what are presently considered to be the preferred embodiments of this invention, it will be obvious to those skilled in the art that various changes and modifications may be made without departing from the broader aspects of this invention. For instance, for curved rod-shaped objects such as hockey sticks, a hole can be provided in an end panel to allow the curved portion of the stick to extend from the sport utility bag thereby reducing the risk of breakage of the curved portion from other items in the primary storage area. Moreover, one or more of the outside compartments on the sport utility bag described herein may be made of a mesh material to allow for proper drying of the contents therein. It is, therefore, aimed in the appended claims to cover all such changes and modifications as fall within the true spirit and scope of the invention.

What is claimed is:

1. A sport utility bag having a top panel, a bottom panel, first and second side panels, and first and second end panels thereby forming a primary storage area, said bag comprising:

handle means coupled to said bag for facilitating grasping and transporting said bag;

closure means for sealing said primary storage area;

a first elongate compartment extending substantially between said first and second end panels, said first elongate compartment having a shape to contain a first generally rod-shaped object; and sealing means for securing said first generally rod-shaped object in said elongate compartment wherein said sealing means is supplied by the inherent elasticity of the material used to form said first elongate compartment so that said first rod-shaped object is securely held in position by said material.

2. The sport utility bag of claim 1 wherein said elongate compartment is formed within and is accessible through said storage area.

3. The sport utility bag of claim 1 wherein said elongate compartment is on the outer surface of said bag.

4. The sport utility bag of claim 1 wherein said sealing means comprises a flap of material extending from an open end of said first elongate compartment to enable access to said first elongate compartment from said open end, said flap including securing means to close said open end.

5. The sport utility bag of claim 4 wherein said securing means is a mating pair of VELCRO loop and VELCRO hook material.

6. The sport utility bag of claim 1 wherein said sealing means is an elongate zipper extending substantially along the length of said first elongate compartment.

7. The sport utility bag of claim 1 further comprising a second elongate compartment extending substantially between said first and second end panels, said second elongate compartment having a shape to contain a second generally rod-shaped object.

8. A sport utility bag comprising:

a primary storage area formed from a plurality of interconnected panels of material;

closure means for sealing said primary storage area;

a plurality of individually accessible compartments on said utility bag with at least one compartment having access means on a bottom surface of said bag;

handle means coupled to said bag for facilitating grasping and transporting said bag; and a first elongate section designed to securely carry a first generally rod-shaped object, said first elongate section having associated therewith at least two straps for securing said first rod-shaped object.

9. A sport utility bag comprising:

a primary storage area formed from a plurality of interconnected panels of material;

closure means for sealing said primary storage area;

a plurality of individually accessible compartments on said utility bag with at least one compartment having access means on a bottom surface of said bag;

handle means coupled to said bag for facilitating grasping and transporting said bag;

a first elongate section designed to securely carry a first generally rod-shaped object wherein said first elongate section comprises a separate elongate compartment to contain said first rod-shaped object; and sealing means for securing said first rod-shaped object in said first elongate compartment wherein said sealing means is supplied by the inherent elasticity of the material used to form said first elongate compartment so that first said rod-shaped object is securely held in position by said material.

* * * * *